United States Patent [19]

Clemensen et al.

[11] Patent Number: 4,738,072

[45] **Date of Patent: * Apr. 19, 1988**

[54] ROOF INSULATION STRUCTURE AND METHOD OF MAKING SAME

[76] Inventors: Carl L. Clemensen, P.O. Box 12090, Wichita, Kans. 67277; Frank T. Mastalka, 4605 Holly St., Denver, Colo. 80216

[ * ] Notice: The portion of the term of this patent subsequent to Dec. 1, 1998 has been disclaimed.

[21] Appl. No.: 297,957

[22] Filed: Aug. 31, 1981

Related U.S. Application Data

[63] Continuation-in-part of Ser. No. 49,279, Jun. 18, 1979, Pat. No. 4,303,713.

[51] Int. Cl.[4] ..... B32B 3/04

[52] U.S. Cl. ..... 52/743; 52/404

[58] Field of Search ..... 52/404, 406, 407, 631, 52/743; 428/155, 126, 121

[56] References Cited

U.S. PATENT DOCUMENTS 2,271,575 2/1942 Waterman ..... 52/406
2,681,702 6/1954 Kuenn et al. ..... 428/155
4,303,713 12/1981 Clemensen et al. ..... 428/121

FOREIGN PATENT DOCUMENTS 606301 10/1960 Canada ..... 428/126
260801 12/1946 Switzerland ..... 52/631
714263 8/1954 United Kingdom ..... 52/404

*Primary Examiner*—James L. Ridgill, Jr.
*Attorney, Agent, or Firm*—Bill D. McCarthy

[57] ABSTRACT

An improved roof insulation structure and method of making the structure for greatly increasing the insulation quality of a metal building roof. The structure includes a self-supporting low to medium density thermal insulation blanket having elongated lines of weakness in the top thereof. The blanket spans the width between a pair of adjacent and parallel roof purlins with one end of the blanket folded up one side of the purlin, folded across the top of the purlin and folded down the opposite side of the purlin, thereby enclosing the top and opposite sides of the purlin. The blanket provides means for receiving a thick blanket of low density thermal insulation inside thereof and between the purlins for increasing the insulation "R" factor of the insulated roof.

2 Claims, 3 Drawing Sheets

ROOF INSULATION STRUCTURE AND METHOD OF MAKING SAME

BACKGROUND OF THE INVENTION

This patent application is a continuation-in-part of an application entitled "A Roof Insulation Structure and Method of Making Same" by the same inventors having Ser. No. 049,279 and filed June 18, 1979 now U.S. Pat. No. 4,303,713 issued Dec. 1, 1981. The patent references cited during the prosecution of the above-mentioned application are incorporated herein by reference.

The invention relates to an improved roof insulation structure and method of making the structure and more particularly, but not by way of limitation, to a self-supporting low to medium density thermal insulation blanket adapted for receipt on top of and folding around parallel roof purlins.

Heretofore there have been various types of metal building roof systems and methods of applying insulation such as the inventions disclosed in U.S. Pat. Nos. 4,047,345, 4,047,346 and 3,969,863 to Alderman, and U.S. Pat. Nos. 3,513,614 and 3,662,509 to Studzinski. Also, various types of grooved self-supporting insulation and methods of grooving the insulation are disclosed in U.S. Pat. No. 3,958,385 to Bondra and U.S. Pat. No. 4,117,641 to Wells. Additional roof insulation systems are disclosed in U.S. Pat. No. 3,979,537 to Troyer and U.S. Pat. No. 2,864,324 to Clements.

None of the patented inventions provide means for receiving and holding low density thick blankets of insulation on top of self-supporting medium density blankets constructed to be contoured around the sides and top of metal roof purlins.

SUMMARY OF THE INVENTION

The subject invention provides a structure and a method of making a roof insulation structure which can be quickly and efficiently mounted on top of and between metal roof buildings for insulating on and around roof purlins, thereby reducing heat loss from around the purlins.

The roof insulation structure has a self-supporting low to medium thermal insulated blanket for receiving a thick blanket of low density thermal insulation thereon so that additional space is provided between the roof purlins for increasing the amount of insulation in the building roof thereby increasing the insulation "R" factor.

The improved roof insulation structure allows insulation contractors to increase the insulation "R" factor of metal building roofs thereby meeting recently adopted stated and federal building insulation codes without having to modify the roof structure.

The self-supporting blanket, when installed, is self-aligning as it is unfolded, tucked adjacent and around the roof purlins. Also the depth of the self-supporting blanket can be increased for receiving various thicknesses of the low density fiberglass blankets between the purlins and allowing full expansion of the fiberglass blankets with virtually no compression.

The improved structure gives the metal building a smooth clean interior finish with a high light-reflectance. Also, the self-supporting blanket gives a tight squared appearance to each purlin space.

The self-supporting blanket provides a continuous enclosure which spans the width between a pair of purlins, up one side of the purlin, across the top of the purlin, down the opposite side of the purlin where the end of the blanket contacts an adjacent blanket. By using this fold around or wrap around structure, heat and cold are greatly reduced along the sides and top of the purlin.

The roof insulation structure includes a blanket of self-supporting thermal insulation. The blanket has from end to end a configuration for receipt around and on top of adjacent and parallel roof purlins. The purlins have a vertical web with upper and lower horizontal flanges integrally attached to the top and bottom of the web. The blanket, when received on and between the purlins, is disposed on top of the upper horizontal flanges of the purlins and adjacent to the vertical web of the purlins. The blanket spans the width between the purlins. When the blanket is folded and tucked adjacent and over the roof purlins, the blanket is then used for receiving a blanket of low density thermal insulation thereon.

The advantages and objects of the invention will become evident from the following detailed description of the drawings when read in connection with the accompanying drawings which illustrate preferred embodiments of the invention.

DETAILED DESCRIPTION OF THE DRAWINGS

During the past few years in the United States the public has become more aware of a growing energy crisis and the rapid depletion of our fossil fuel reserves used in heating and cooling buildings and in internal combustion engines. State and federal government have reacted to this crisis by legislating stricter building codes requiring increased insulation in new building construction to lower power consumption in the heating and cooling of buildings.

In the building insulation industry an insulation "R" factor is used to indicate the thickness of insulation and its resistance to heat and cold loss to the outside atmosphere. The higher the "R" factor the greater the resistance to heat and cold transfer. In wall and roof insulation a one inch to one and one-half inch blanket of self-supporting low to medium density thermal insulation will have an "R" factor of 4. A three inch blanket has an "R" factor of 10, a six inch blanket "R" 19, and a ten inch blanket "R" 30.

A goal of the metal building industry, in order to meet proposed and new state and federal codes, is to provide metal building roofs with an "R" factor of between 15 and 50.

The inventors of the subject invention, being owners of successful metal building insulation companies, seek to meet and exceed the industry goal by using the following described improved roof insulation structure and method of making the structure to the betterment of the metal building industry and the American public.

Figure 1:
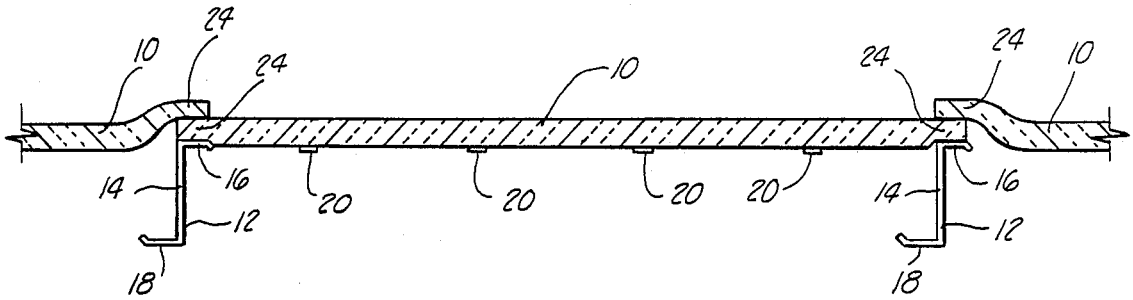
FIG. 1 PRIOR ART
FIG. 1 is a cross sectional end view of prior art construction using a self-supporting low to medium density insulation blanket spanning between two metal roof purlins with the ends of the blanket overlapping on top of the upper horizontal flanges of the purlin.

In FIG. 1 a cross sectional end view of prior art construction of insulating a metal building roof is illustrated. In this view a one and one-half to two inch thick self-supporting low to medium density thermal insulation blanket 10 is shown spanning the width between two metal roof purlins 12. In metal roof construction, the more "Zee" type purlin, such as purlins 12, are used. There are "C" shaped purlins which are used, but they are not as common as the "Zee" type purlin. The purlins 12 include a vertical web 14 integrally attached to an upper horizontal flange 16 and a lower horizontal flange 18. This type of purlin generally has the dimensions of nominal three inch wide horizontal flanges 16 and 18 with the vertical web 12 in a range of eight to ten inches.

Figure 5:
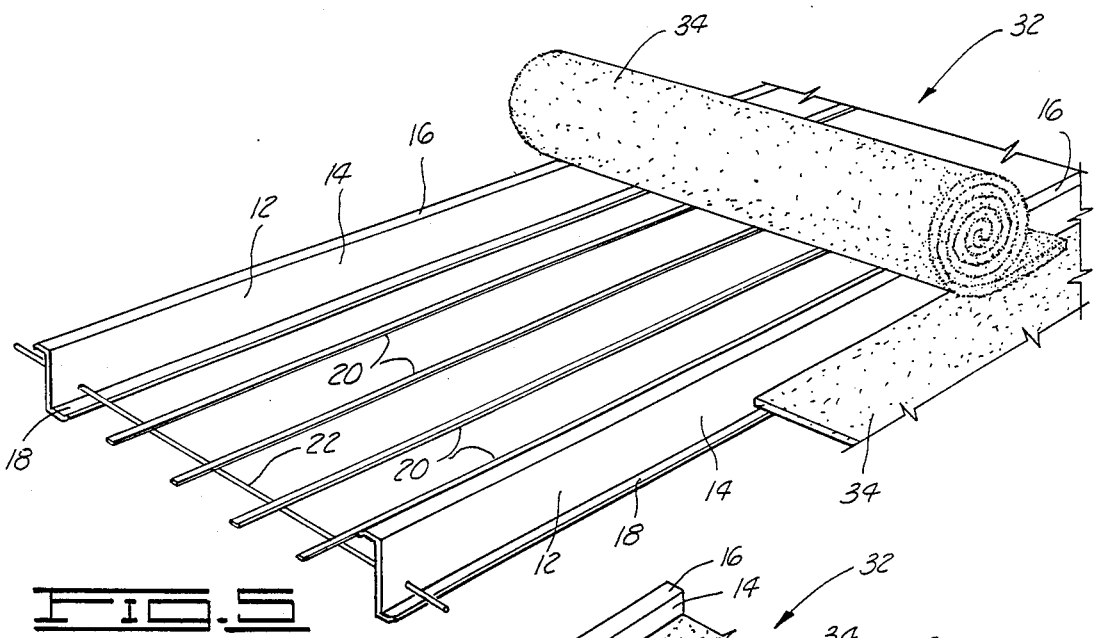
FIG. 5 is a perspective view of a typical metal roof building having a pair of parallel roof purlins with metal banding ready to receive a roll of the self-supporting blanket.
Figure 10:
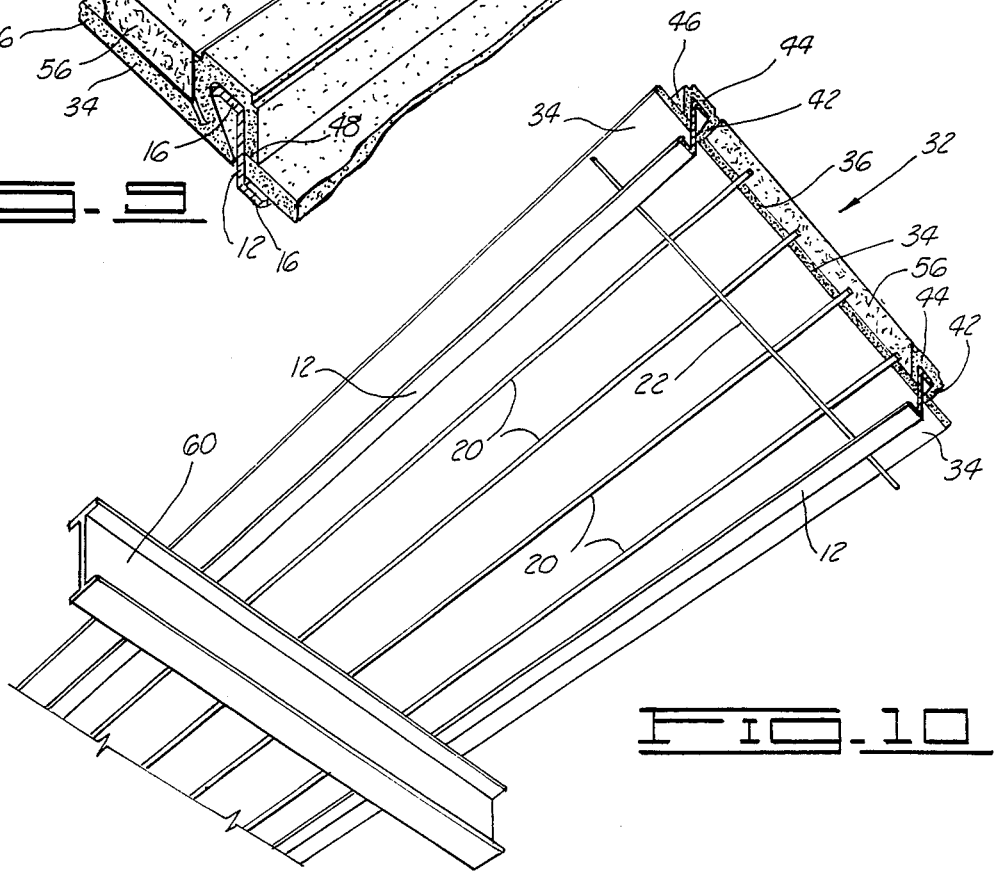

The self-supporting blanket 10 rests on top of longitudinal metal banding 20 and lateral banding 22. The lateral banding 22 is shown in FIG. 5 and FIG. 10. Depending on the thickness of the insulation blanket, the longitudinal banding 20 and lateral banding 22 will be adjusted along the height of the web 14 of the purlins 12.

Side portions 24 of the blanket 10 are received on top of the upper flanges 16 of the two purlins 12 with side portions 24 of adjacent blankets 10 overlapping and on top thereof. The two sides 24 of the adjacent blankets 10 are then compressed on top of the upper flanges 16 by roof sheeting 26 shown in FIG. 9 and used to cover the top of the metal building roof.

From reviewing this cross sectional end view of the prior art insulated roof, it can be seen that a heat loss occurs in and around the top of the purlins 12 due to the necking down of the sides of the blankets 10 when they are attached to the top of the upper flanges 16. Also the metal purlins 12, being subject to the heated interior of the building, act as heat sinks and dissipate the heat to the atmosphere in the compressed area or decreased insulation area adjacent the upper flanges 16.

Figure 2:
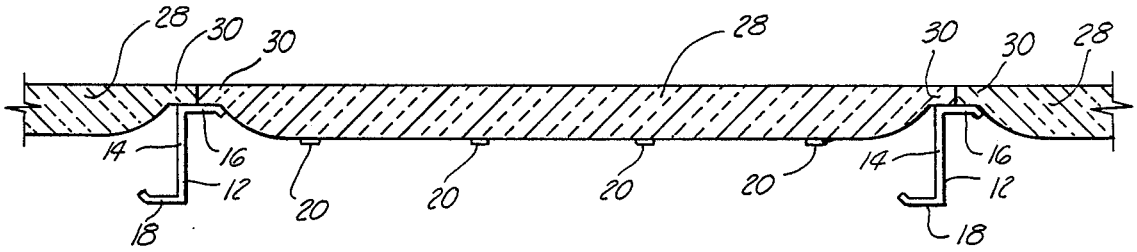
FIG. 2 PRIOR ART
FIG. 2 is a cross sectional end view of prior art construction using a low density thicker insulation blanket with the ends of the blanket in a butt joint with adjacent blankets of insulation.

In FIG. 2 and additional prior art roof insulation structure is illustrated wherein a thicker low density thermal insulation blanket 28 is used. The blanket 28 in this case can be in the range of three to four inches thick with side portions 30 in a butt joint relationship to the side portions 30 of the adjacent blankets 28. In this view it can be seen that the longitudinal banding 20 has been lowered when compared to the banding 20 shown in FIG. 1 so that the increased thicknesses of the blanket 28 can be accommodated. Again, heat loss is created by the neck-down area of the side portions 30 when they are secured to the top of the horizontal flanges 16 of the purlins 12.

Figure 3:
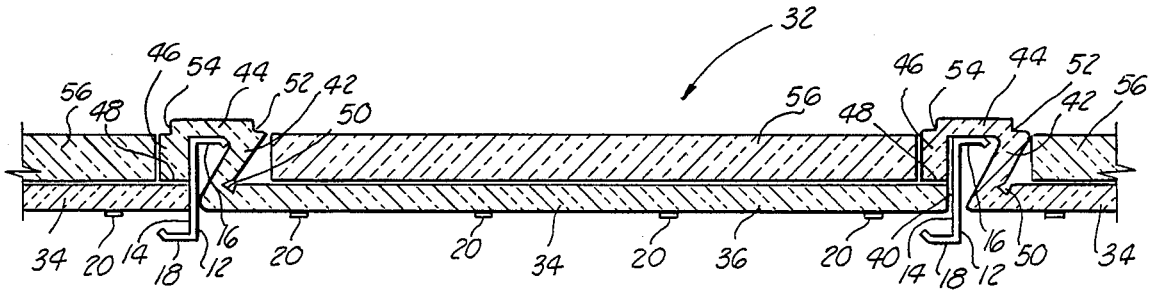
FIG. 3 is a cross sectional end view of the improved roof insulation structure illustrating a purlin wrap around configuration of a self-supporting low to medium density thermal insulation blanket receiving a low density thick insulation blanket thereon.

In FIG. 3 the improved roof insulation structure of the subject invention is designated by general reference numeral 32. The improved structure 32 includes a self-supporting low to medium density thermal insulation blanket 34. The blanket 34 may be in the range of one to one and one-half inches thick. The blanket may also have dimensions less or greater than this range and still accomplish the purpose of the subject invention.

The blanket 34 has an elongated width portion 36 which spans the width between the adjacent purlins 12 with a first end portion 40 butting up against one side of the web 14. The blanket 34 also includes a first side portion 42, a top portion 44, and a second side portion 46 with a second end portion 48 for folding or wrapping around the opposite sides of the web 14 and the upper flange 16 of the purlin 12. The second end portion 48 is disposed above and adjacent to the first end portion 40 of another blanket 34 between adjacent purlins 14. The second end portion 48 may be secured to the adjacent first end portion 40 by an adhesive tab, tape or the like.

The width portion 36 is divided along the length of the blanket 34 from the first side portion 42 by an elongated notch 50. The notch 50 allows the side portion 42 to be folded adjacent the upper side of the web 14 and at an acute angle with the width portion 36. The top portion 44 is divided along the length of the blanket 34 from the first side portion 42 by an elongated slit 52. The slit 52 allows the top portion 44 to be folded on top of the flange 16 and at an acute angle with the first side portion 42. The second side portion 46 is divided along the length of the blanket 34 from the top portion 44 by an elongated slit 54. The slit 54 allows the second side portion 46 to be folded at a right angle along the opposite side of the web 14.

By providing the self-supporting blanket 34, the longitudinal banding 20 and lateral banding 22 can be lowered between the purlins 12 to accommodate a thick low density thermal insulation blanket 56. Depending on the "R" factor required, the blanket 56 can vary from four to eight inches thick or greater and still have sufficient space in the roof structure without the blanket 56 being compressed against the bottom of the metal sheeting 26 when it is secured to the upper flanges 16 of the purlins 12.

Figure 4:
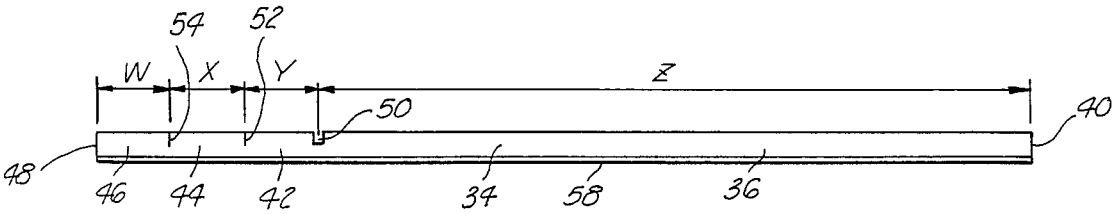
FIG. 4 is an end view of the self-supporting blanket with slits and notches cut therein prior to folding around a roof purlin.

In FIG. 4, an end view of the self-supporting blanket 34 is illustrated. In this view a vapor barrier sheet 58 is attached to the bottom of the blanket 34. The vapor barrier sheet may be made of vinyl or any other standard laminate facing material. Prior to folding the blanket 34 around and between the purlins 12, the slits 52 and 54 and notches 50 are cut into the top of the blanket 34. The slits and notches can generally be made during the laminating of the fiberglass insulation blanket 34 to the vapor barrier sheet 58. Typical dimensions of width W is in a range of 7" to 9", X in a range of 3" to 7", and Y in a range of 8" to 10". An overall width Z is in a range of 48 to 60 inches. Again, these dimensions will vary depending on the types of purlins used and the width between the purlins. Also, the dimensions will vary depending on the thickness of the low density blanket 86 used. It should be noted that while slits and notches are mentioned above broadly, various types of lines of weakness such as grooves, slots, perforations and the like could be used to fold the blanket 34 around the purlin 12 and still be within the scope of the invention as described.

Figure 6:
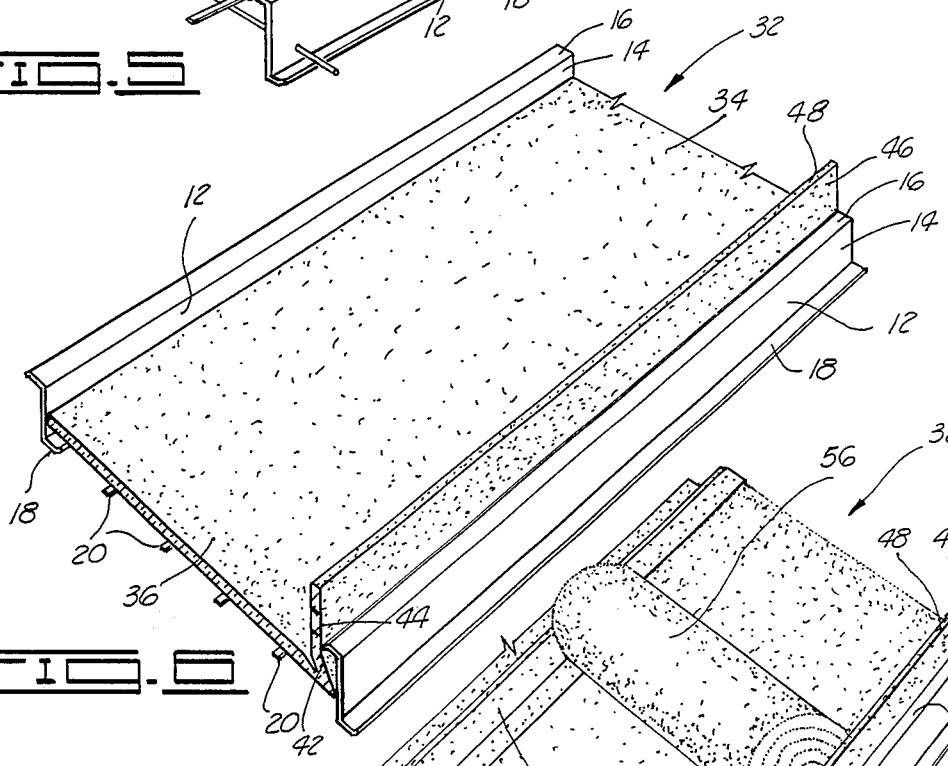
Figure 7:
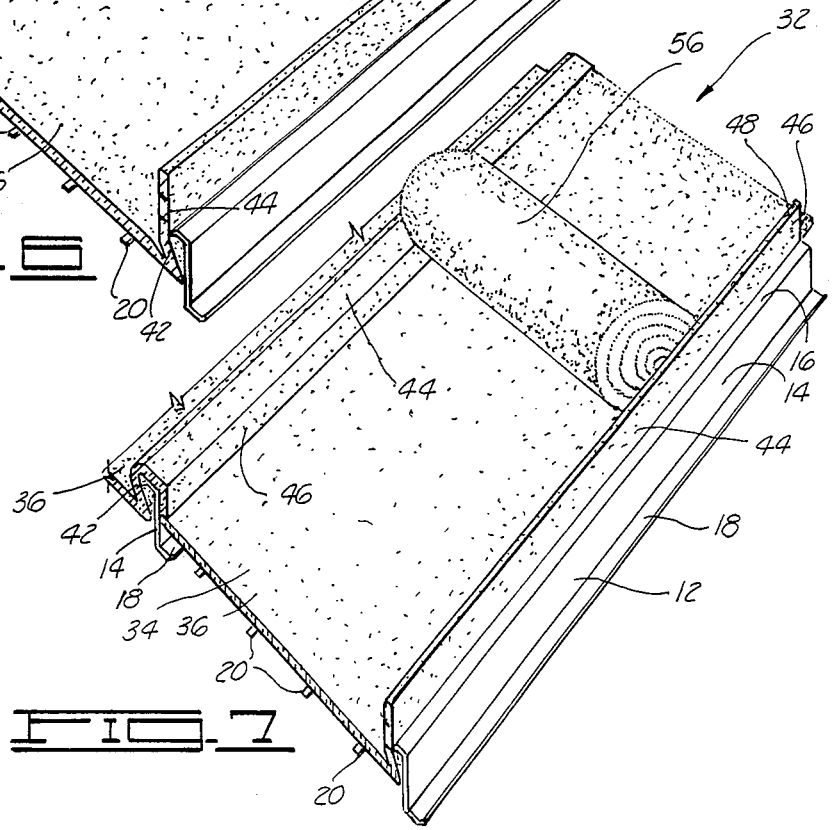

In referring to FIGS. 5, 6 and 7, the improved roof insulation structure 32 is illustrated in how it is applied on and between the metal roof purlins 12. As mentioned in the discussion of FIG. 4, the self-supporting blanket 34 is then unrolled as shown in FIG. 6, with the first side portion 42 folded against the side of the vertical web 14 of the purlin 12 with the width portion 36 placed on top of the longitudinal and lateral banding 20 and 22. One of the advantages of the structure 34 is that by the preslitting and notching of the blanket 34, it automatically provides a predetermined fold of the blanket 34 and self-aligns itself as it is folded and tucked adjacent the webs 14 of the purlins 12. This feature provides for reduced time, labor and improved safety in installing roof insulation material.

Also seen in FIGS. 6 and 7 are the side portions 42 and 46, and top portion 44 extending upwardly in a vertical position. In FIG. 7 a roll of the thick low density insulation blanket 56 is partially unrolled onto the top of the width portion 36 of the blanket 34.

Figure 8:
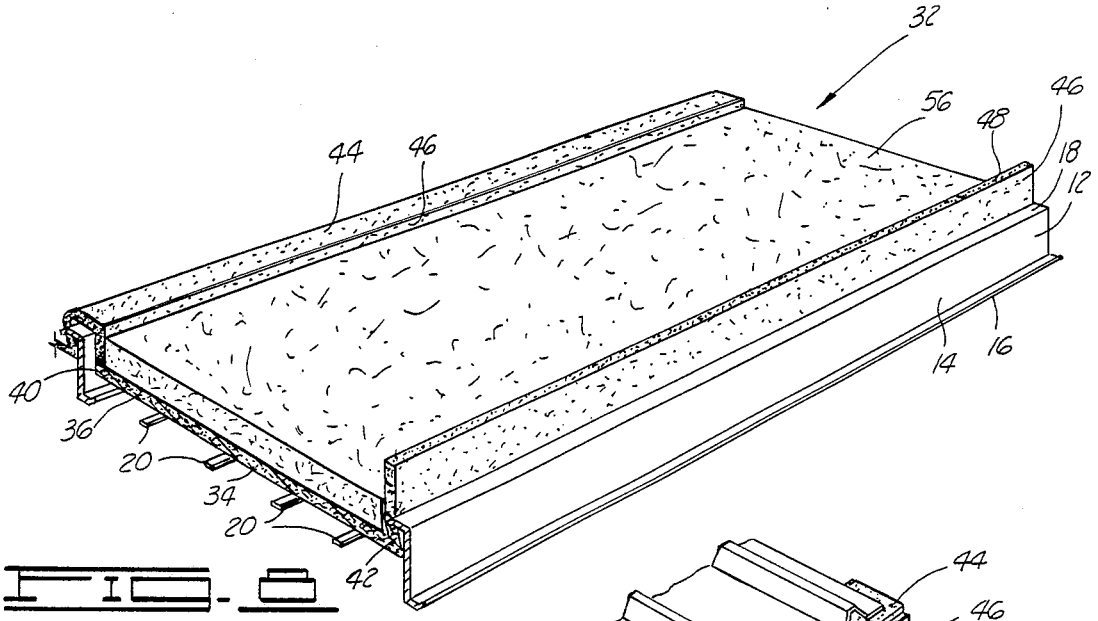

In FIG. 8 the thick low density blanket 56 has been completely unrolled and received on top of the width portion 36 of the self-supporting blanket 34.

Figure 9:
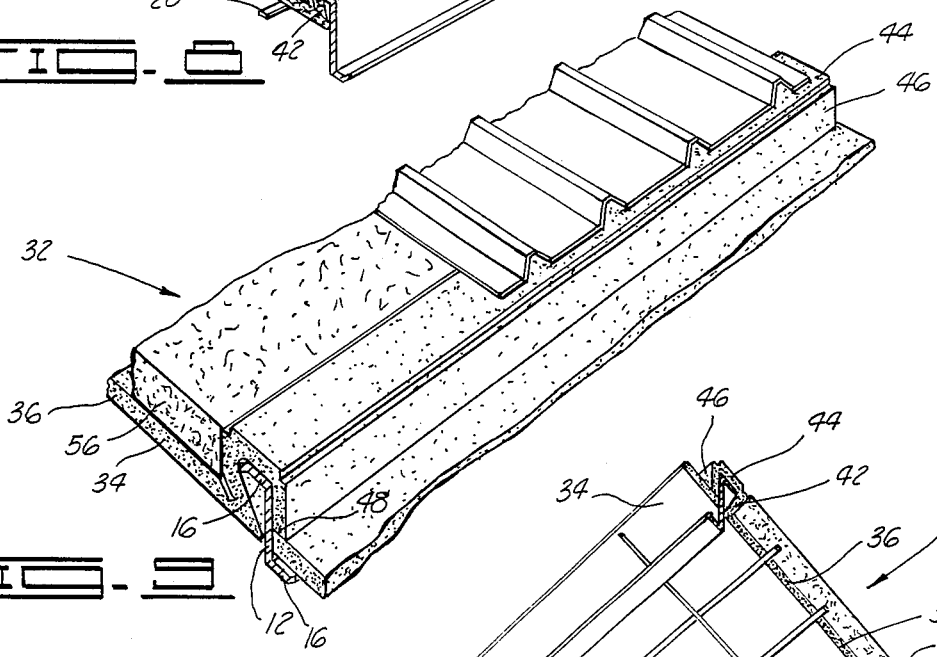

In FIG. 9 a partial perspective view of one of the purlins 12 is illustrated receiving the metal sheeting 26 on top of the upper flange 16 of the purlin 12. Prior to receiving the sheeting 26, the top portion 44 is folded into a horizontal position on top of the upper flange 16 where it is compressed between the sheeting 26 and the upper flange 16.

In FIG. 10, a perspective view of the roof structure is illustrated viewing the bottom of the self-supporting insulation blanket 34 completely installed between the purlins 12 and on top of the longitudinal and lateral banding 20 and 22. In this view a building I beam 60 can be seen at right angles to the purlins 12 and supporting the purlins 12 thereon. Also seen in this view is an end view of the blanket 34 with the width portion 34 spanning the width between the purlins 12, the side portions 42 and 46 folded and tucked adjacent the web 14 of the purlins 12 with the top portion 44 of the blanket 34 on top of the upper flanges 16 of the purlins 12. Also in a nesting relationship is the thick low density thermal insulation blanket 56 resting inside the blanket 34.

From reading the above detailed description and viewing the drawings as described, it can be appreciated that through the use of a self-supporting low to medium density insulation blanket disposed on top of, beside and between roof purlins, additional space is provided in a roof structure for receiving thicker insulation blankets. This type structure provides a roof insulating contractor with an increased area to add insulation thereby increasing the insulation "R" factor of the building and providing the owner of the building with overall reduced heating and cooling costs.

Changes may be made in the construction and arrangement of the parts or elements of the embodiments as described herein without departing from the spirit or scope of the invention defined in the following claims.

What is claimed is:

1. A method of insulating the top of a roof having a pair of adjacent and parallel roof purlins, the purlins having a vertical web and upper and lower horizontal flanges integrally formed into the top and bottom of the web forming a "Zee", "C", truss or bar joist type configuration, the steps comprising:

forming a first line of weakness in the top of a blanket of self-supporting low to medium density thermal insulation and along the length thereof and forming a width portion for receipt between the purlins;

forming a second line of weakness parallel to the first line of weakness in the top of the blanket and in a spaced relationship thereto and along the length thereof, the space between the two lines of weakness forming a first side portion for receipt adjacent the side of the web of the purlin;

forming a third line of weakness parallel to the second line of weakness in the top of the blanket and in a spaced relationship thereto and along the length thereof, the space between the second and third lines of weaknesses forming a top portion, the space between the third line of weakness and the edge of the blanket forming a second side portion;

rolling the blanket into a roll for transportation to and onto the roof;

unrolling the blanket between the adjacent purlins;

folding inwardly the first side portion along the first line of weakness of the blanket upwardly from the width portion with the width portion spanning the width between the adjacent purlins and the first side portion tucked adjacent the vertical web of the purlin;

folding the top portion along the second line of weakness on top of the upper horizontal flange; and folding the second side portion along the third line of weakness adjacent the opposite side of the web of the purlin.

2. The method as described in claim 1 further including the step of unrolling a thick blanket of low density thermal insulation on top of the self-supporting blanket and between the purlins.

* * * * *